United States Patent [19]

Suddaby

[11] Patent Number: 4,768,958

[45] Date of Patent: Sep. 6, 1988

[54] LASER BEAM PROJECTOR AND MOUNTING MEANS THEREFOR

[75] Inventor: Peter Suddaby, East Grinstead, United Kingdom

[73] Assignee: Gentronic Holdings Limited, New Addington, England

[21] Appl. No.: 6,671

[22] PCT Filed: May 15, 1986

[86] PCT No.: PCT/GB/8600270

§ 371 Date: May 18, 1985

§ 102(e) Date: Jan. 15, 1987

[87] PCT Pub. No.: WO86/07138

PCT Pub. Date: Dec. 4, 1986

[30] Foreign Application Priority Data

May 18, 1985 [GB] United Kingdom ..... 8512600

[51] Int. Cl.[4] ..... F41G 3/26

[52] U.S. Cl. ..... 434/21; 89/14.05; 89/41.06; 89/41.01

[58] Field of Search ..... 434/21; 89/14.05, 41.06, 89/41.01

[56] References Cited

U.S. PATENT DOCUMENTS

| | | | |
|---|---|---|---|
| 3,510,965 | 5/1970 | Rhea | 434/21 |
| 3,938,262 | 2/1976 | Dye et al. | 434/21 |
| 4,048,489 | 9/1977 | Giannetti | 434/21 |
| 4,367,516 | 1/1983 | Jacob | 434/21 |

*Primary Examiner*—Leo P. Picard

*Attorney, Agent, or Firm*—James C. Wray

[57] ABSTRACT

An alignment plug for mounting a laser beam projector assembly on the barrel of a weapon, comprising an elongate body (10) of substantially cylindrical cross-section of which a first body portion serves for location within the muzzle end of the barrel and a second body portion serves for attachment of the projector assembly. A window (17) in said plug serves for entry of light emitted on detonation of a blank round, the light being transmitted to a light detector (14) by a light guide (16) to initiate projection of a coded laser beam. Aperture means (8, 9) extending axially of said plug serves to relieve the pressure of the detonation to the exterior of the barrel.

15 Claims, 4 Drawing Sheets

LASER BEAM PROJECTOR AND MOUNTING MEANS THEREFOR

Figure 1:
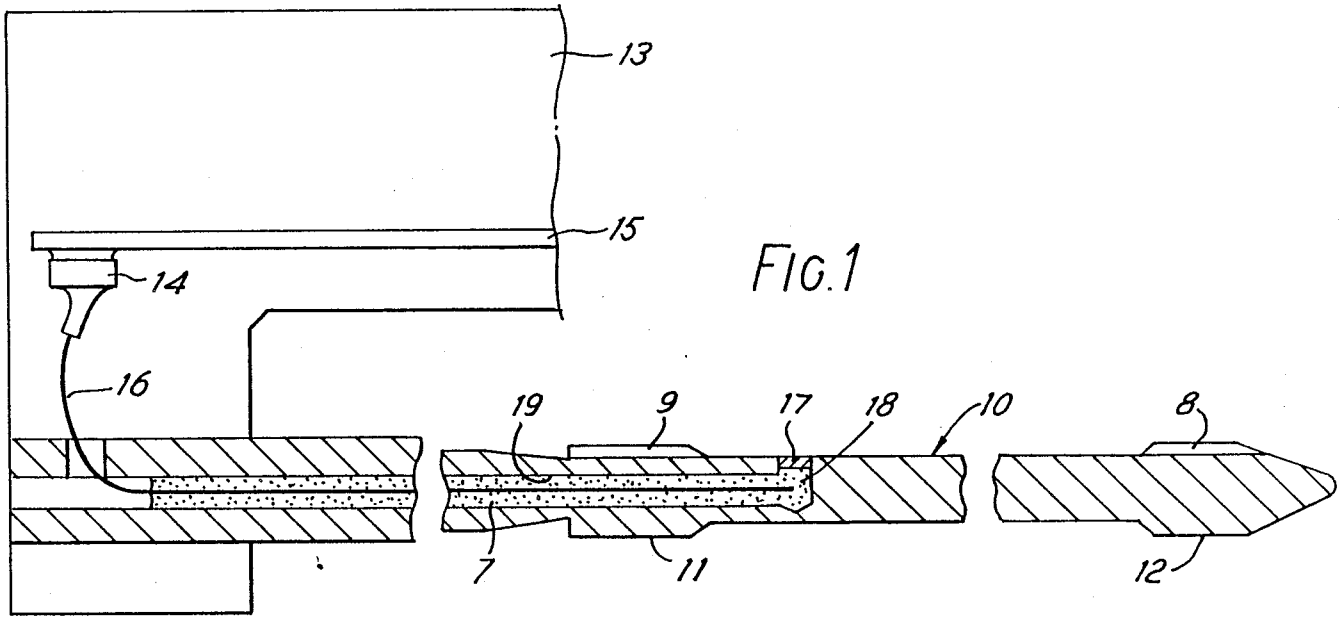

This invention relates to a laser beam projector for simulating the firing of a projectile such as a bullet and more particularly to means for mounting the projector on a weapon barrel. The means for mounting is primarily intended for small arms infantry weapons such as rifles, automatic rifles and machine guns, though the invention can be equally applied to larger calibre weapons and also to vehicle mounted weapons.

Existing equipment known as weapons effect simulators generally employ a pulsed laser beam to give a harmless representation of a bullet for use in weapons training situations. The potential target is equipped with detectors sensitive to the laser pulse, which indicate a "kill" or "near miss" when the pulse is detected. In order to achieve realistic training, two parameters are important in the design of the laser projector, these are:

(1) The laser beam must be aligned with the correct aiming point of the weapon.

(2) The laser pulse must be transmitted at a time coincidental with firing a blank round.

Existing equipment achieves item (1) for small arms weapons by either incorporating a sight into the laser projector, or by a fitting procedure which involves adjustment of either the weapons sights or the projector. Item (2) is generally achieved by analysis of the weapon vibration, noise or muzzle flash.

An object of the invention is to provide a method for achieving immediate self-aligment of the laser beam of the projector while retaining undisturbed use of the weapon sights. A further object is to provide a simple method for detecting the detonation of a blank round for the purpose of initiating the laser beam.

A further object is to provide an alignment plug so designed for use with blank ammunition that automatic and semi-automatic weapons function normally.

According to the invention there is provided an alignment plug for mounting a light beam projector assembly on the barrel of a weapon, comprising an elongate body of substantially cylindrical cross-section of which a first body portion serves for location within the muzzle end of the barrel and a second body portion serves for attachment of the projector assembly, a window in said plug for entry of light emitted on detonation of a blank round, a light detector, means for transmitting light entering said window, and aperture means extending axially of said plug and serving to relieve the pressure of the detonation to the exterior of the barrel.

The gas pressure relief passage may take the form of slots or holes running axially along the alignment plug, to allow pressure relief from the barrel to the atmosphere. the relief passage has an effective cross section sufficient to allow pressure to remain in the barrel, after each blank round is fired, so that the weapon recocks normally. The alignment plug is therefore suitable for automatic and semi-automatic weapons.

Where the relief passage is chosen in the form of slots, there may be of such a number that do not interfere with the weapon rifling grooves, and may be of helical form (of opposite hand to the weapon rifling grooves).

The projector may be permanently attached to the plug and aligned at the time of manufacture, permitting automatic self-alignment with the weapon barrel and hence the exit trajectory of a real bullet, when mounted on the barrel by the user. In this way the projector does not have to be aligned on the weapon in the workshop or in the field.

The alignment plug replaces the conventional blank fire adaptor, normally employed on automatic and semi-automatic weapons, and must enable the normal recocking to occur after each round. The plug may be secured to the weapon by similar means to that employed by the blank fire adaptor.

Figure 2:
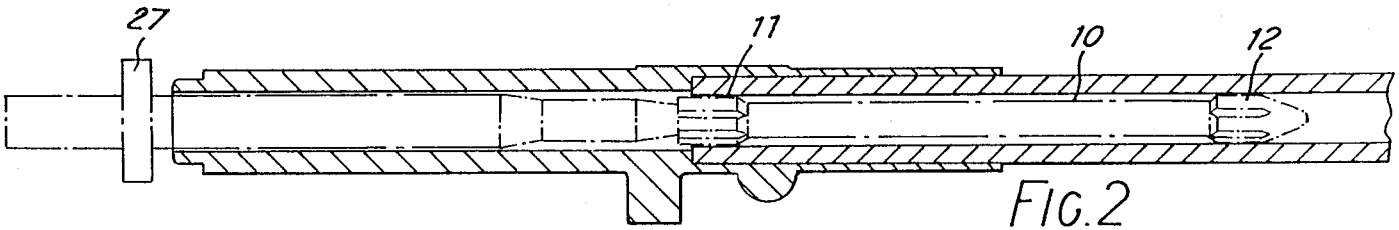
Figure 3:
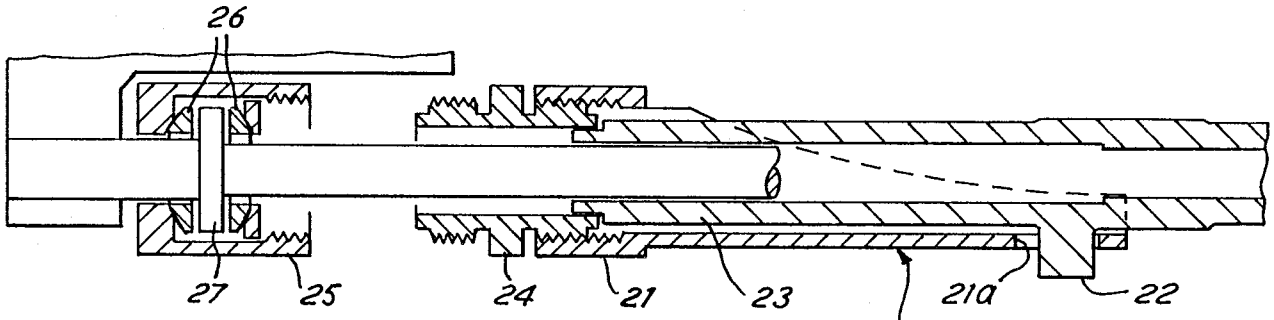
Figure 4:
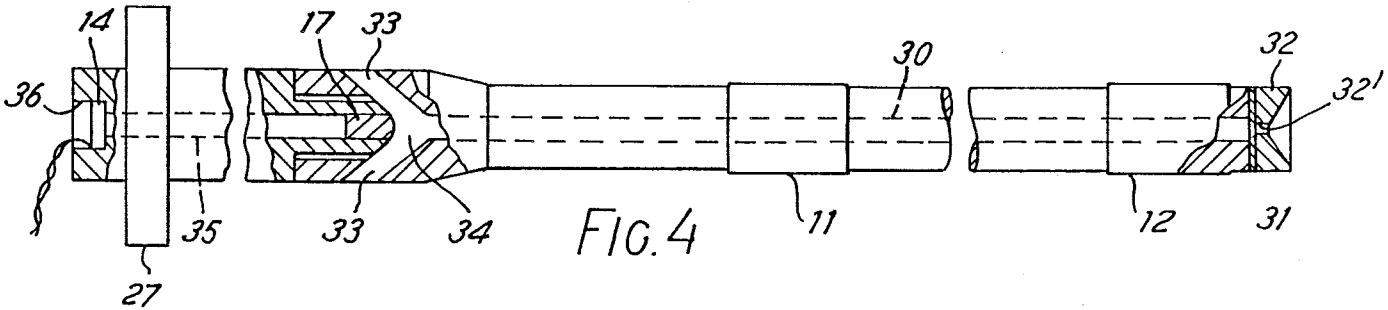
Figure 5:
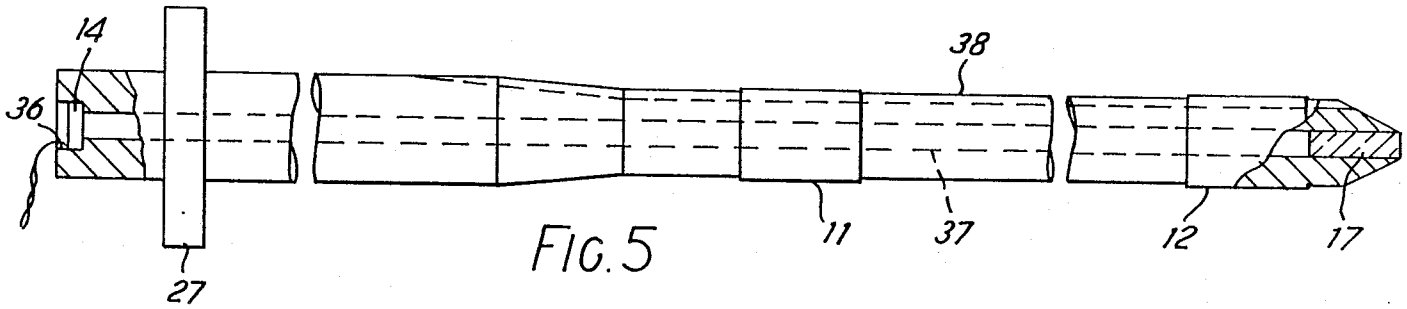
Figure 6:
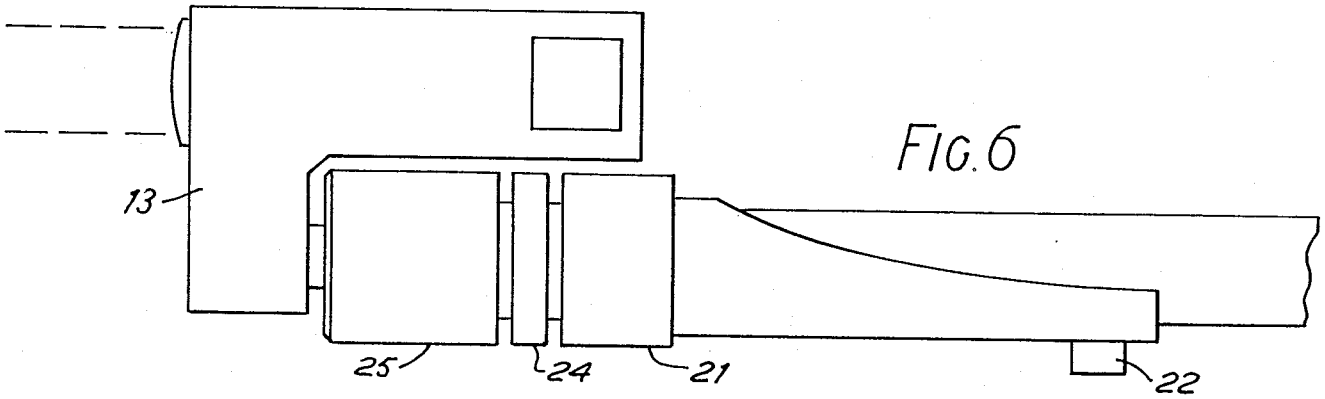
Figure 7:
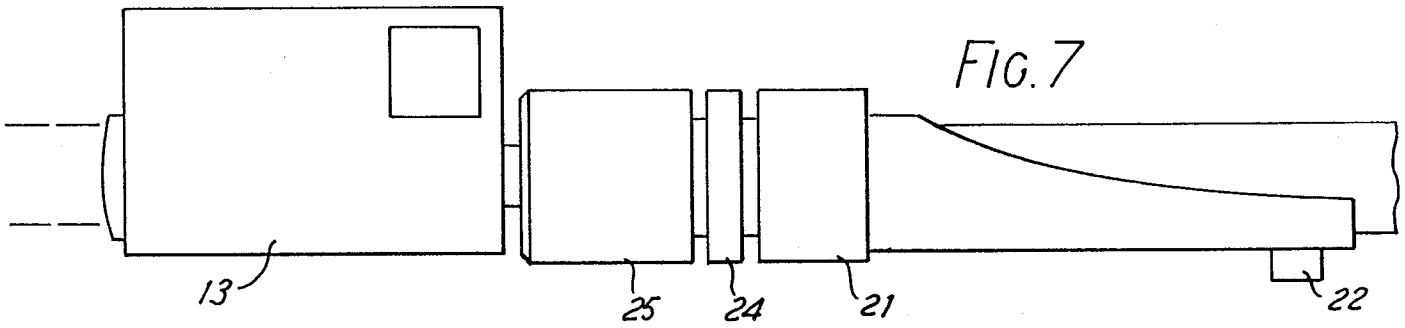
Figure 8:
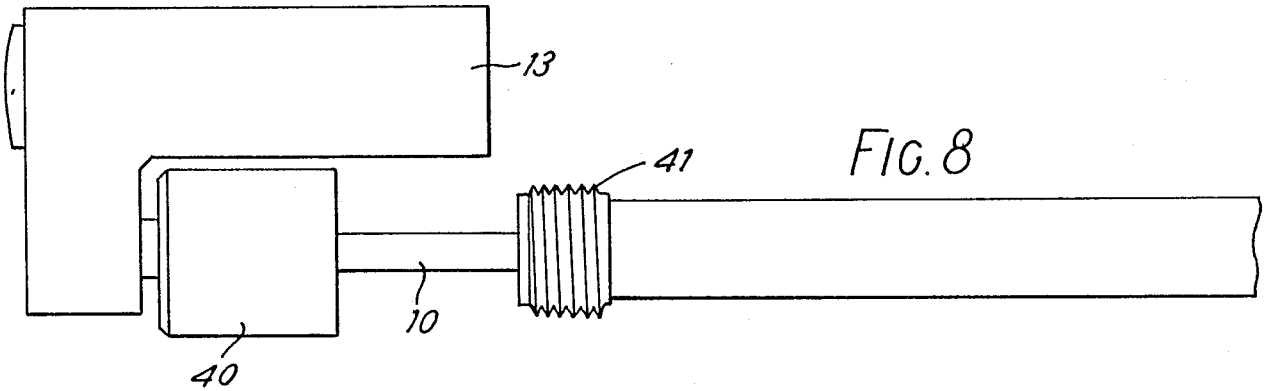

The invention will now be described by way of example with reference to the accompanying drawings in which:

FIG. 1 is a longitudinal section of an alignment plug of a projector assembly, FIG. 2 is a section of an alignment plug similar to that of FIG. 1 shown in position within a rifle barrel and its flash eliminator, FIG. 3 shows a mounting assembly for the alignment plug and a portion of the latter, FIGS. 4 and 5 show longitudinal sections of two further embodiments of alignment plugs, FIG. 6 is a part elevation showing of a light beam projector of a kind in which the lens is offset from the axis of the barrel, and with a mounting assembly on a barrel having a lug, FIG. 7 shows the projector assembly with the lens aligned with the axis of the barrel, and with a mounting assembly located by the barrel lug, and FIG. 8 shows the projector assembly with offset lens axis attached to a barrel having a threaded end.

The alignment plug shown in FIG. 1 comprises an elongate member 10 of substantially cylindrical cross-section which is machined to a high state of accuracy in accordance with the bore of the weapon to be adapted. The plug is provided with two axially spaced apart lands serving as locating surfaces 11, 12 (e.g. 10 cms apart overall) having close tolerance sliding fit in the weapon barrel. The locating surfaces include 5 axial slots 8,9 for gas pressure relief, of total area similar to the orifice of the existing blank fire attachment. The choice of 5 slots ensures that no mechanical interference occurs with weapons having 3, 4 or 6 rifling grooves. The accuracy of alignment can be increased by increasing the length of the plug, however 10 cms length is considered sufficient for a beam accuracy of over 300 m range.

Mounted at the end of the plug is a laser projector 13 of a known kind having beam initiating means (not shown) including a sensor 14 capable of detecting light emitted from a source on actuation of the weapon firing mechanism. The light source would normally emanate from the detonation of each round of blank ammunition fired in the usual way in the chamber of the weapon. Preferably the sensor comprises a photoelectric diode mounted on a printed circuit board 15 activated by the light source by way of a light transmitting means in the form of a light guide 16 (typically a fibre optic cable) provided between the diode 14 and a light entry window 17 within the plug. The window 17 is provided in the alignment plug in a radial bore 18 leading to an axial bore 19 containing the light guide.

The window 17 is made from glass, and may be either cemented into a recess in the plug or applied in a molten state. The assembly must be manufactured to withstand the vibration, pressure and heat of repeated detonations of blank ammunition. The material of the plug must have the same heat expansion characteristics as the glass window (a chrome-iron alloy called NILO-K (Registered Trade Mark) is a suitable example).

The light guide is located in the axial bore 19 (or axial recess) which is then filled with a plastics filler 7 such as ISOPON (Registered Trade Mark) which secures the cable and permits the transmission of light from the window into the light guide. The free end of the light guide 16 is terminated at the diode 14 in the projector assembly.

By this construction the flash which occurs upon detonation of the blank round is detected immediately, and provides the initiation signal to transmit a laser beam in pulse code.

FIG. 2 shows the plug inserted into the barrel of an L1A1 (SLR) weapon. The flash eliminator is not removable on this weapon, and therefore the plug extension is required which passes through the flash eliminator.

The plug and projector assembly may be attached to a rifle by means of an attachment assembly 20 (FIG. 3) comprising a bracket 21 attached between the bayonet lug 22 entering an aperture 21*a* and the front end of the flash eliminator 23, and is secured by means of a coupler 24 tightened by a C-spanner. This method of fitting is similar to the existing blank fire adaptor of the weapon. The plug and projector assembly is attached to the coupler 24 by means of a threaded locking cap 25, again secured by a C-spanner. The locking cap 25 is provided with washers 26 having frusto-spherical surfaces, which engage on opposite sides of a flange 27 (not shown in FIG. 1) formed integrally with the plug 10.

The laser alignment is assured by the location of the plug in the weapon barrel (FIG. 2). The locking cap incorporates freedom of movement in the angular and linear directions prior to tightening, by means of the spherical washers 26. The alignment therefore remains undisturbed and unstrained as the locking cap is tightened. Final tightening ensures a firm support to carry the weight of the projector housing, and to absorb knocks and loading experienced during normal use.

In the plug shown in FIG. 4 the gas relief passage is provided by an axial bore 30 which also serves to permit light to enter the plug axially instead of from the side as in the example shown in FIG. 1. At the gas entry end of the bore 30 there is provided a restrictor member 31 welded to the plug end having a countersunk axial bore 32 dimensioned in accordance with the weapon onto which the projector assembly is to be mounted.

At a position remote from the entry end the axial bore 30 communicates with two passages 33 formed in the plug at about 45 degrees to the plug axis. The outlet ends of these passages 33 are arranged to be in the region of the slots (not shown) provided in the flash eliminator of the weapon.

In this example the window 17 is located on the plug axis and has its entry aperture in the junction 34 formed by the bore 30 and the inclined passages 33. Light entering the window 17 passes along an axial bore 35 serving as the light transmitting means to the photoelectric diode 14 located in a recess 36.

The lands 11, 12 which are accurately machined to fit the weapon barrel are only a few microns larger in diameter than the remainder of the plug portion which enters the barrel. The plug therefore makes for greater rigidity and stability of the projector assembly than in the case of the smaller waisted plug.

The plug shown in FIG. 5 is formed with an axial bore 37 serving as light transmitting means passing through the entire length of the plug, the window 17 being located at the extreme end of the plug.

The window 17 in all these examples is provided in the alignment plug to protect the photoelectric diode from the pressures, temperatures and sooting within the barrel. As an option, an additional light transmitting means in the form of a light guide may run from the window to the photoelectric diode to enhance transmission of the flash signal. The window may be made from any suitable transparent material which will withstand the temperature and pressure in the barrel, and which is compatible with the material of the alignment plug.

In any of these examples a glass window may be used, in which case the material of the plug must be carefully chosen to have the same heat expansion characteristics, so that a perfect seal between glass and plug is ensured. A chrome-iron alloy called NILOK is a suitable example. Alternatively, a quartz window may be brazed or swaged into the plug material or a transparent ceramic or sapphire may be used, which also may be brazed or swaged into the plug material.

The window is located in the alignment plug in such a position to transmit sufficient light from the detonation flash, while also limiting the temperature and pressure exposure to within the characteristics of the window material.

Quartz and sapphire both have a higher melting temperature than glass, and therefore may be placed in a more exposed position on the alignment plug.

A high temperature braze may be used to seal the quartz or sapphire window to the plug, and such a method will withstand a higher temperture than a glass window.

A mechanical method of sealing the window, typically by swaging or by taper, will permit a higher temperature tolerance, limited by the plug material temperature characteristics.

The laser projector assembly is configured to suit the most convenient position for the weapon type. Two alternative positions are shown in FIGS. 6 and 7 designed in accordnce with weapon balance considerations and with a low profile to avoid obstructing the line of sight from the weapon sights to the target. The assembly contains electronic equipment and laser optical equipment. Power is supplied by a dry cell battery housed in the projector assembly.

The laser optical system provides a collimated beam from a gallium arsenide laser diode source. The direction of the beam is carefully adjusted during manufacture to be parallel with the plug. When installed, the beam is therefore automatically in alignment with the weapon barrel. If necessary the beam may be set with a slight downwards tilt, to compensate for the live bullet fall-of-shot at longer ranges. The laser beam is transmitted as a coded series of pulses, compatible with the detectors attached to the target.

The electronic system initiates the laser beam and generates the coded sequence.

The method of attachment to the weapon is readily applicable to any type of service rifle. An individual adaptor bracket will be required for each weapon type, which may be designed to attach to the lugs normally provided on the weapon for the bayonet and other attachments. Many weapons include a screw thread at the barrel tip (such as the M16, H & K G3 and Steyr AUG), and this can provide a direct attachment point. Such an arrangement is shown in FIG. 8 in which the plug 10 is secured by means of a locking cap 40 to the threaded tip 41 of the barrel.

The detonation flash provides an ideal discrete event with which to initiate the laser pulse. The timing is coincident with detonation and permits complete transmission of the laser before the weapon moves under recoil. The invention therefore provides an advantage over known systems in which the laser beam is activated accoustically, the weapon jumping before the beam is initiated resulting in considerable inaccuracy. The flash intensity in the barrel is stronger than outdoor daylight. Thus an unmistakable signal is provided which requires no analysis or cross-check, with a consequent reduction in electronic components.

What is claimed is:

1. An alignment plug for mounting a light beam projector assembly on a barrel of a weapon, comprising (a) an elongate body of substantially cylindrical cross-section of which a first body portion serves for location within the muzzle end of the barrel and a second body portion serves for attachment of the projector assembly, (b) a window in said plug for entry of light emitted on detonation of a blank round, (c) a light detector, (d) means for transmitting light entering said window to said detector, and (e) aperture means extending axially of said plug and serving to relieve the pressure of the detonation to the exterior of the barrel.

2. A plug according to claim 1, wherein said elongate body is provided with two axially spaced lands in the region of the first body portion.

3. A plug according to claim 2, wherein said window is provided at a radial bore formed in the waisted region of the plug between the two lands.

4. A plug according to claim 3, wherein the light transmitting means comprises a light guide cable located within an axial bore extending from a position adjacent said radial bore to an exit aperture at the end of the second body portion of the plug.

5. A plug according to claim 2, wherein said aperture means comprise axially extending grooves formed in the surfaces of the lands.

6. A plug according to claim 1, wherein said aperture means comprise an axial bore in said elongate body passing through said first portion and into said second body portion, exit passages for the gas being provided in said second body portion in communication with said axial bore and extending to the exterior cylindrical surface of the plug.

7. A plug according to claim 6, wherein said window is located at the juncture of the axial bore and the exit passages, said window being arranged in a further axial bore in said second body portion serving as the light transmission means, said light detector being mounted in the end of the further axial bore which is remote from the window.

8. A plug according to claim 7, wherein an additional light transmitting means is provided between the window and the light detector.

9. A plug according to claim 1, wherein the light transmitting means is in the form of an axial bore extending over the entire length of the plug, said window being located at one end thereof and said light detector and the other end, said aperture means being in the form of a plurality of grooves extending axially along the elongate body over the entire length of the first body portion and at least part of the second body portion.

10. A plug according to claim 1, wherein said window is made of glass.

11. A plug according to claim 1, wherein said window is made of any one of quartz, transparent ceramic and sapphire secured by one of brazing and swaging methods.

12. A plug according to claim 1, wherein said elongate body is formed with a flange at an end region of the second body portion serving as an abutment member for attachment of the plug to the barrel.

13. A plug according to claim 12, wherein an attachment assembly is provided having a locking cap, washers having frusto-spherical surfaces engaging respectively on each side of the flange, a threaded connecting piece receiving at one side said locking cap, and a bracket for application to the end of the barrel or a flash eliminator thereon, said bracket being screwed onto the other side of said connecting piece and being formed with an aperture or projection for cooperation with an existing projection or recess respectively, formed on the weapon.

14. A plug according to claim 12, wherein an attachment assembly is provided having a locking cap axially secured but rotatable on said elongate body at the second body portion, said locking cap serving to engage an existing externally threaded portion at the barrel end.

15. A light beam projector assembly including an alignment plug for mounting said assembly on a barrel of a weapon, comprising an elongate body of substantially cylindrical cross-section of which a first body portion serves for location within the muzzle end of the barrel and a second body portion serves for attachment of the projector assembly, a window in said plug for entry of light emitted on detonation of a blank round, a light detector, means for transmitting light entering said window to said detector, and aperture means extending axially of said plug and serving to relieve the pressure of the detonation to the exterior of the barrel.

* * * * *